US005921103A

United States Patent [19]

Hilsinger

[11] Patent Number: 5,921,103

[45] Date of Patent: Jul. 13, 1999

[54] PORTABLE ICE-MAKING APPARATUS

[76] Inventor: Craig W. F. Hilsinger, 2800 Devils Backbone Rd., Cincinnati, Ohio 45233

[21] Appl. No.: 08/927,500

[22] Filed: Sep. 10, 1997

[51] Int. Cl.[6] ..... F25C 5/18

[52] U.S. Cl. ..... 62/340; 62/344

[58] Field of Search ..... 62/3.63, 340, 344

[56] References Cited

U.S. PATENT DOCUMENTS

| | | | |
|---|---|---|---|
| D. 354,292 | 1/1995 | Monti | D15/80 |
| 2,899,804 | 8/1959 | Carew | 62/344 |
| 3,131,551 | 5/1964 | Ross | 62/344 |
| 3,226,944 | 1/1966 | Connors | 62/344 |
| 4,612,779 | 9/1986 | Hatton | 62/344 |
| 4,722,199 | 2/1988 | Hibino | 62/344 |
| 5,020,336 | 6/1991 | Hida | 62/344 |
| 5,119,639 | 6/1992 | Bein et al. | 62/137 |
| 5,211,030 | 5/1993 | Jameson | 62/344 |
| 5,361,602 | 11/1994 | Furukawa et al. | 62/344 |

FOREIGN PATENT DOCUMENTS

| | | | |
|---|---|---|---|
| 5-240541 | 9/1993 | Japan | 62/344 |

OTHER PUBLICATIONS p. 431 Igloo Ice Chests catalog page.

*Primary Examiner*—William E. Tapolcai
*Attorney, Agent, or Firm*—Wood, Herron & Evans LLP

[57] ABSTRACT

A portable and weather-resistant ice-making apparatus (10) includes an ice-making unit (20) supported by a frame (22) and contained within a housing (24), the frame and housing being adapted to removably rest atop a cooler (12) or other similarly sized storage bin. The frame includes lower side and end members (30, 32) joined together at their ends to define a rectangular support structure for the ice-making unit. The lower surfaces of the side and end members are adapted to rest atop the upper edge (18) of the cooler to support the apparatus thereon. The housing includes depending lips (62) which extend downward below the vertical level of the lower surfaces of the frame members on the outside of the cooler, the lips preventing the apparatus from sliding off the upper edge of the cooler. The housing is resistant to intrusion of precipitation, having vents (50) located in end walls (52) which are inwardly recessed beneath the upper portion or lid (40) of the housing. The housing includes a body (42) to which the lid is pivotally connected by a hinge (44). The lid and body interconnect at an overlapping joint (48) which helps prevent intrusion of precipitation.

17 Claims, 3 Drawing Sheets

PORTABLE ICE-MAKING APPARATUS

FIELD OF THE INVENTION

The present invention relates to apparatus for making ice, and more particularly, to a portable ice-making apparatus which is substantially weatherproof and is capable of producing large quantities of ice rapidly.

BACKGROUND OF THE INVENTION

Machines for making ice are well known. An ice-making machine generally consists of a reservoir for holding a quantity of water to be made into ice, a refrigeration unit which cycles a two-phase refrigerant through a vapor-liquid cycle to cause cooling and freezing of the water in the reservoir, and an integral bin for storing ice made by the refrigeration unit. The machine typically has an ice-harvesting system which ejects ice from the reservoir and through an outlet chute to the storage bin, and automatic controls for operating the ice-harvesting system and for introducing water into the reservoir following a harvesting sequence.

The vast majority of stand-alone ice-making machines have been intended for use in a single location, generally indoors or in an area sheltered from the weather. For instance, commercial ice-making machines are commonly used in food service establishments, hotels, and the like. A commercial ice-making machine usually has an ice-making unit including a refrigerant compressor, an evaporator, a condenser, a water reservoir, and plumbing and electrical systems, all of which are housed in a cabinet above an ice storage bin. The ice-making unit is permanently mounted to or with respect to the storage bin. Because the machine is not intended to be moved frequently, it is generally relatively large and heavy, and is usually permanently plumbed into a plumbing system and hard-wired into an electrical system at its location of use. Furthermore, because it is sheltered from the weather, the typical ice-making machine does not have features permitting it to be safely used outdoors.

While conventional ice-making machines are capable of producing ice in large quantities, for example up to 800 pounds per day for large commercial units, it is not practical to place them in certain locations where large amounts of ice are desired. For instance, boat docks, camping grounds, and other relatively remote locations where users desire ice, typically do not have suitable plumbing, electrical, and/or shelter facilities that would permit a large ice-making machine to be installed. Although portable ice-making machines have been developed, they generally do not produce ice rapidly enough to be practically used by a commercial proprietor of ice, or where quantity demands usually exceed their production capacity. Consequently, commercial proprietors of ice in remote locations generally purchase bags of ice from an off-site commercial ice manufacturer, and store the bags of ice in an insulated or refrigerated storage chest or cooler for resale to customers. Such "manufactured" ice, however, is relatively expensive, and certain locations may not have access to an ice-supply service.

There has thus been a need for a large-capacity ice-making apparatus capable of being safely used outdoors in inclement weather. There has been a further need for an ice-making apparatus which can be used at a relatively remote location which has access to potable water and to electricity but which does not have modern plumbing and electrical systems. There has also been a need for a large-capacity portable ice-making apparatus which is easily movable from one location to another.

SUMMARY OF THE INVENTION

The above and other objects of the invention are achieved by providing an ice-making apparatus having an ice-making unit contained within a housing which provides protection from the elements and having features permitting it to be removably yet securely placed atop a generally standard-sized open top end of a normal large-capacity insulated chest or cooler. In this position atop a cooler, the apparatus is supplied with water and electrical power, and operated to produce ice, which is dumped from the ice-making unit directly into the cooler. When the desired quantity of ice has been deposited in the cooler, the apparatus may be easily lifted off the cooler and either placed atop another cooler or rested on the ground or other support surface.

More specifically, the apparatus includes an ice-making unit, a frame which has a bottom wall supporting the ice-making unit, and a housing containing the frame and ice-making unit. The housing includes a top wall and side walls which cover the top and sides, respectively, of the ice-making unit. The housing further includes a pair of depending lips which are parallel to and outward of opposite side edges of the frame bottom wall. The bottom wall of the frame is adapted to rest on the upper peripheral edges of a cooler, the cooler edges contacting the bottom wall inward of the depending lips. Contact between the bottom wall and the cooler establishes a substantially air-tight seal to reduce heat transfer into the cooler, a compressible gasket preferably being attached to the bottom wall to facilitate sealing. The lips prevent the apparatus from sliding sideways off the cooler. The lips are preferably of sufficient structural strength that the apparatus, when not in use atop a cooler, may be placed on the ground or other support surface with the lips supporting the apparatus.

The housing includes features for making the apparatus substantially weather-proof. To this end, the housing includes inwardly recessed air vents which are shielded from above by upper portions of the housing so that rain and other precipitation are substantially prevented from entering the vents. Furthermore, the construction of the housing assures that water is substantially prevented from infiltrating the housing. Thus, the housing preferably includes a lower body portion and an upper lid portion, the body and lid including upper and lower edges, respectively, which engage each other to form a substantially water-tight joint. Preferably, the edges overlap to form the joint. The lid is preferably hinged to the body at one end thereof to permit the lid to be opened for access to the ice-making unit.

The housing is advantageously constructed of a glass fiber and resin composite material, such as Fiberglas, which provides a high strength-to-weight ratio. The weight of the apparatus is thus maintained low enough to permit two people to easily lift and transport the apparatus from one location to another. The housing advantageously includes handles at each end to facilitate lifting and carrying of the apparatus.

The apparatus has a weather-proof electrical inlet to which an electrical power cord may be attached for supplying electrical power to the apparatus. The apparatus also has fittings for attaching a water supply line or hose and a water drain line or hose. The ice-making unit is capable of operating on virtually any alternating current source delivering a current of about 15 amps or more. Thus, the apparatus can be operated either outdoors or indoors, as long as there is access to a water source capable of producing potable water in sufficient quantity, and to a source of suitable electrical power.

The invention also provides an optional extension member which is adapted to sit atop a cooler, with the ice-making apparatus resting atop the extension member. The extension member permits production and temporary storage of a greater quantity of ice than the cooler alone is capable of holding, by essentially making the side walls of the cooler higher. The extension member includes a door in a side wall thereof, the door being openable to provide access to the ice stored in the cooler.

The above and other objects and advantages of the invention will become more apparent by reference to the following detailed description and the accompanying drawings of a preferred embodiment of the invention.

DETAILED DESCRIPTION OF THE DRAWINGS

Figure 1:
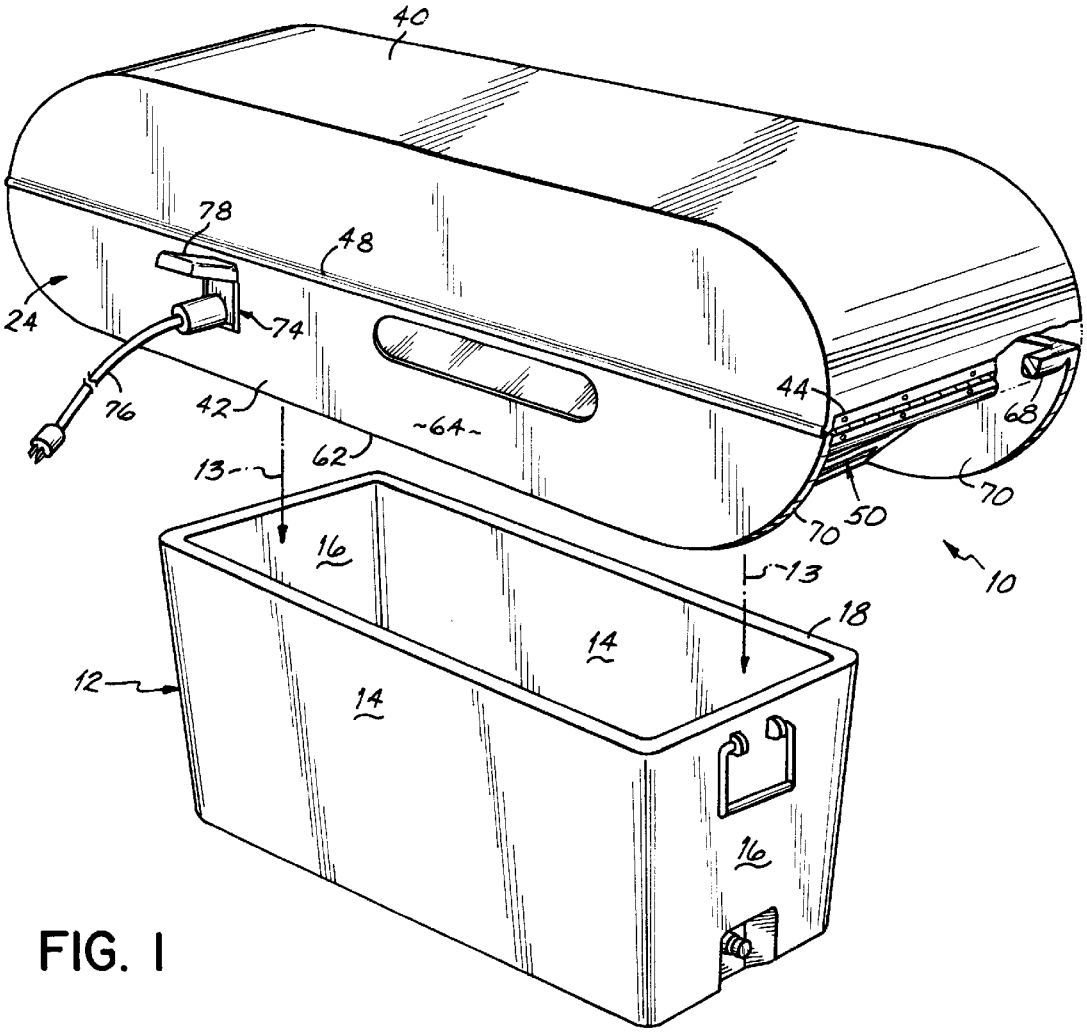
FIG. 1 is a perspective view of an ice-making apparatus in accordance with the principles of the invention, shown being lowered onto the top of a cooler.

FIG. 1 depicts an ice-making apparatus 10 in accordance with the principles of the present invention. The apparatus 10 is shown in a position vertically above a generally box-shaped cooler 12. The apparatus 10 is lowered onto the top of the cooler 12, as indicated by arrows 13, in order to place the apparatus 10 in an operating position. The cooler 12 is a large-capacity insulated cooler having a volume capacity of about 120 to about 170 quarts. The cooler 12 has upstanding side and end walls 14 and 16, respectively, and a bottom wall (not visible in FIG. 1). The top of the cooler 12 is open, a hinged or removable lid (not shown) serving to close the open top of the cooler 12 when the ice-making apparatus 10 is removed therefrom. The side and end walls 14 and 16 at their upper extremities define a generally rectangular upper peripheral edge 18. The edge 18 has a width of about 18 to 21 inches, and a length of about 42 to 49 inches.

The ice-making apparatus 10 is designed to rest atop the cooler edge 18, in which position the apparatus may be operated to dispense ice directly into the cooler 12. The apparatus 10 includes features which provide a seal between the apparatus 10 and the cooler edge 18, and which prevent excessive sliding motion of the apparatus 10 on the cooler 12, as described below.

Figure 2:
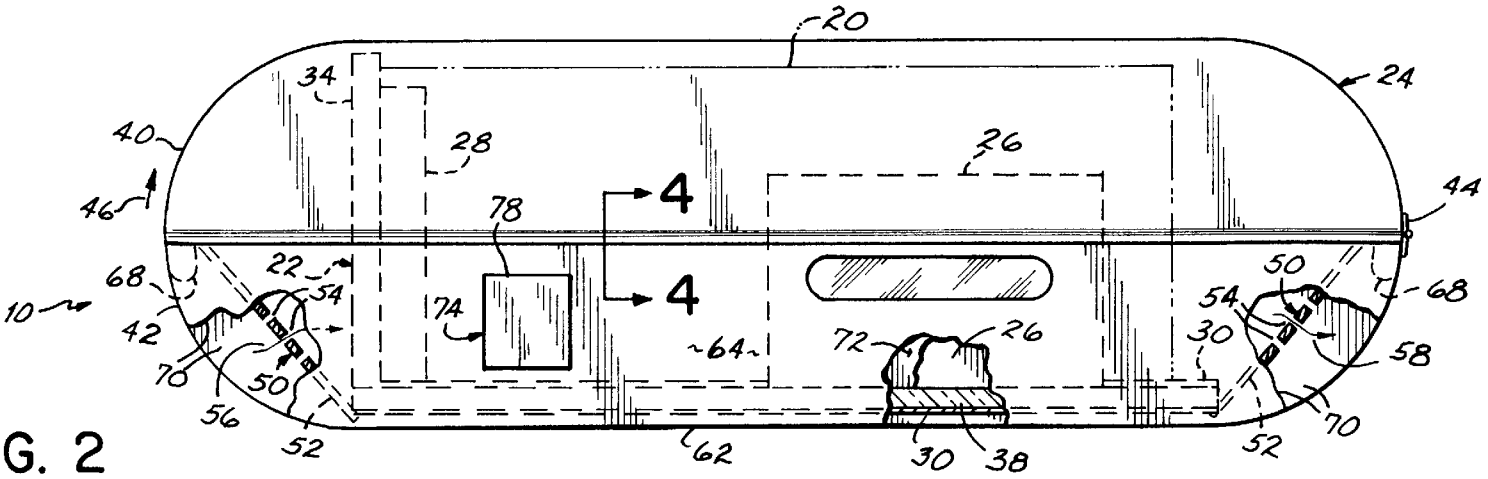
FIG. 2 is a side elevational view of the ice-making apparatus.
Figure 3:
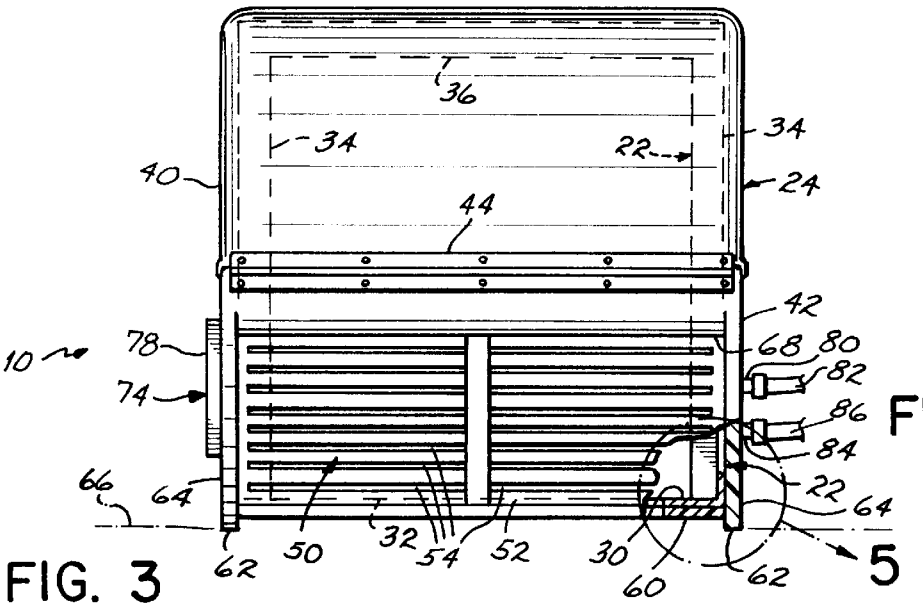
FIG. 3 is an end elevational view of the ice-making apparatus, partially cut away to show the frame with its bottom wall and gasket.

With reference to FIGS. 1–3, the apparatus 10 includes an ice-making unit 20 (shown schematically in the drawings), a frame 22 which supports the ice-making unit 20, and a housing 24 which contains the ice-making unit 20 and the frame 22. The ice-making unit 20 is a conventional type of unit having a refrigerant compressor (not shown), an evaporator 26, and an air-cooled condenser 28, and a water reservoir (not shown) which is cooled by exchanging heat with the evaporator 22 in order to make ice. The ice-making unit 20 also has automatic controls (not shown) for initiating an ice-making sequence, freezing, and harvesting a batch of ice, as well known in the industry. Preferably, the ice-making unit 20 is capable of operating on any single-phase electrical power supply having a voltage of about 115 to about 230 volts, a cycle of 50 to 60 Hertz, and at least about 10 amps of current at 115 volts and about 5 amps at 230 volts. For example, a Model J200 ice-making unit, available from The Manitowoc Company of Manitowoc, Wis., is suitable. Such a unit is capable of producing 200 or more pounds of ice per day. The combination of such a unit in a portable housing together with selected ones of a variety of typical insulated coolers provides ice in heretofore unavailable quantities in remote and outdoor applications.

With reference to FIGS. 1 and 2, the frame 22 is constructed of aluminum angle pieces joined together, preferably by welding. The frame 22 includes two longer bottom members 30 and two shorter bottom members 32 joined together at their ends to form a rectangular support structure providing the primary structural support for the ice-making unit 20. The bottom members 30 and 32 preferably are 2"×1"⅛" angle aluminum, with the longer legs of the angle oriented horizontally and the shorter legs extending vertically upward from the horizontal legs. The bottom members 30 and 32 are preferably joined at their ends by miter joints so that their bottom surfaces are flush with one another. The frame 22 further includes two upright members 34 joined to the bottom members adjacent first ends of the longer members 30 where the members 30 are joined to opposite ends of one of the shorter bottom members 32. A top cross member 36 is joined at its ends to the upper ends of the upright members 32. The upright members 34 and cross member 36 provide support for the condenser 28.

The ice-making unit 20 is fastened with fasteners (not shown) to the horizontal legs of the frame bottom members 30 and 32. A layer of insulation 38 is disposed between the ice-making unit 20 and the frame bottom members 30 and 32, as shown in FIG. 2. The insulation 38 provides increased thermal isolation of ice in the cooler 12 from the heat of the ice-making unit 20. The insulation is preferably a water resistant foam material.

Figure 4:
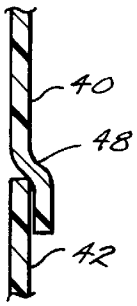
FIG. 4 is a cross-sectional view taken on line 4—4 of FIG. 2, showing the joint between the lid and the body of the housing.

The housing 24 is advantageously constructed of a resin and glass fiber composite material, such as Fiberglas, and is formed in two halves which fit together in a substantially water-tight manner. Thus, the housing 24 includes an upper lid 40 and a lower body 42. The lid is attached by a hinge 44 to the body 42 at one end thereof, so that the lid 40 may be swung upward as indicated by arrow 46, pivoting about the hinge 44, to provide access to the ice-making unit 20 for service. When in the closed position as shown in the drawings, the lid 40 engages the body 42 in an overlapping joint 48, as shown in the cross-sectional view of FIG. 4. The overlapping design of the joint 48 substantially prevents water, such as rainfall, from infiltrating the housing at the joint 48. Any water running downward along the outer surfaces of the lid 40 will flow over the joint 48 and be prevented from entering the housing. The housing 24 thus shields the ice-making unit 20 from unwanted water intrusion.

With reference to FIGS. 2 and 3, the housing 24 also includes recessed vents 50 at each end of the apparatus (only one vent 50 shown in FIG. 3). More specifically, the body 42 has opposite end walls 52 which are inclined at an angle, sloping upward and outward. The end walls 52 are overhung by the lid 40. Each end wall 52 has a plurality of louvered openings 54 forming the vent 50. The vents 50 provide air circulation through the apparatus 10. The ice-making unit 20 includes a fan (not shown) adjacent the condenser 28 for drawing air through the vent 50 at one end of the apparatus 10, as indicated by arrow 56. Air exits through the vent 50 at the other end of the apparatus 10, as indicated by arrow 58. The recessed design of the vents 50 substantially prevents water, such as rain or other precipitation, from infiltrating the housing 24 at the vents 50.

Figure 5:
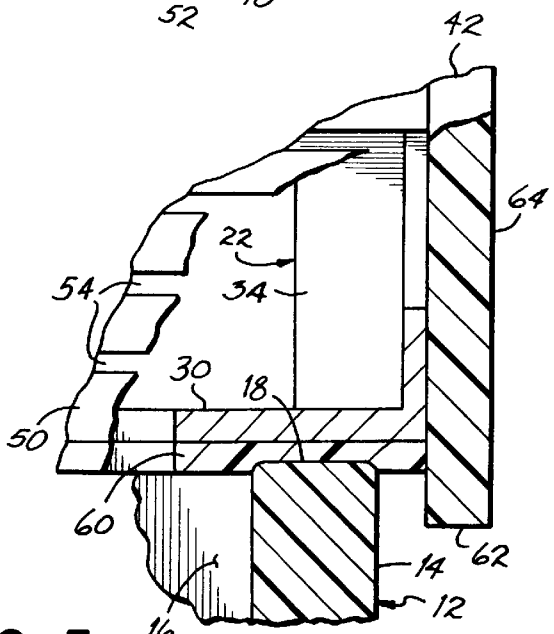
FIG. 5 is an enlarged view of encircled area 5 of FIG. 3, showing the interface between the apparatus and the upper edge of the cooler.

With reference to FIGS. 3 and 5, the apparatus 10 rests atop the cooler 12 with the frame bottom members 30 and 32 supporting the apparatus 10 on the upper edge 18 of the cooler 12. A gasket 60 preferably is attached to the lower surface of the frame members 30 and 32 around the entire perimeter of the frame 22. The gasket 60 is compressed between the upper edge 18 of the cooler 12 and the frame members 30 and 32, providing a substantially air-tight seal therebetween, which helps insulate ice in the cooler 12 from heat outside the cooler 12.

The housing 24 is adapted to rest securely atop a variety of coolers such as the cooler 12 without sliding off, by virtue of two depending lips 62 which extend downward below the vertical level of the gasket 60. The lips 62 comprise lower edges of the opposite side walls 64 of the housing body 42. The lips 62 are spaced apart by a distance which exceeds the width of the widest cooler 12 to be used in conjunction with the apparatus 10, so that the apparatus 10 will sit on the cooler 12 with the gasket 60 compressed against the cooler upper edge 18. The lips 62 prevent the apparatus 10 from sliding sideways off the cooler 12. Preferably, the lips 62 are structural members of sufficient strength that, when not in use atop a cooler, the apparatus 10 may be placed on the ground or other support surface 66 with the lips 62 supporting the entire weight of the apparatus 10, as shown in FIG. 3. Thus, the gasket 60 is prevented from contacting the ground 66 and being damaged.

The apparatus 10 also includes a pair of recessed handles 68 at opposite ends of the housing 24 to facilitate lifting and transport of the apparatus 10. Each handle 68 extends between a pair of spaced-apart flanges 70 which comprise longitudinal extensions of the body side walls 64. In addition to serving as supports for the handles 68, the flanges 70 also serve to provide shielding to the vents 50 from water directed sideways against the body 42.

The housing 24 advantageously includes a layer of insulation 72 attached to the inner surface (not shown) of the housing 24 adjacent to the evaporator 26, as shown in FIG. 2. The insulation 72 helps provide increased thermal isolation of the evaporator 26 from its higher-temperature surroundings, improving the efficiency of the unit 20.

The apparatus 10 includes a weather-proof electrical inlet 74 for connecting an extension cord 76 to supply electrical power to the apparatus 10. The inlet 74 may be covered when not in use by a lid 78 which is hingedly connected to the body 42 so as to protect the inlet 74 from the elements.

The apparatus 10 also includes a water inlet fitting 80 for connection of a water supply line 82, and a water outlet fitting 84 for connection of a water drain line 86.

In use, the apparatus 10 is placed atop a cooler 12 with the gasket 60 compressed against the upper edge 18 of the cooler 12. A water supply line 82 is connected at one end to a suitable water supply and at the other end to the water inlet fitting 80, and a water drain line 86 is connected at one end to the water outlet fitting 84 and the free end of the drain line 86 is routed to a suitable drain. The water supply is turned on, supplying water through the supply line 82 to the apparatus 10. An electrical cord 76 is connected at one end to a suitable electrical power source and at the other end to the weather-proof inlet 74 to begin the ice-making function. Alternatively, a toggle switch (not shown) may be included for supplying and interrupting electrical power to the apparatus after the electrical cord 76 has been connected.

The ice-making unit 20 then automatically cycles through an ice-making sequence followed by an ice-harvesting sequence, dumping a batch of ice into the cooler 12 at the completion of the harvesting sequence. The unit 20 continues making and harvesting ice until it is turned off, or until the cooler fills to the top with ice such that an automatic shut-off switch (not shown) is activated, as is well known in the industry.

Figure 6:
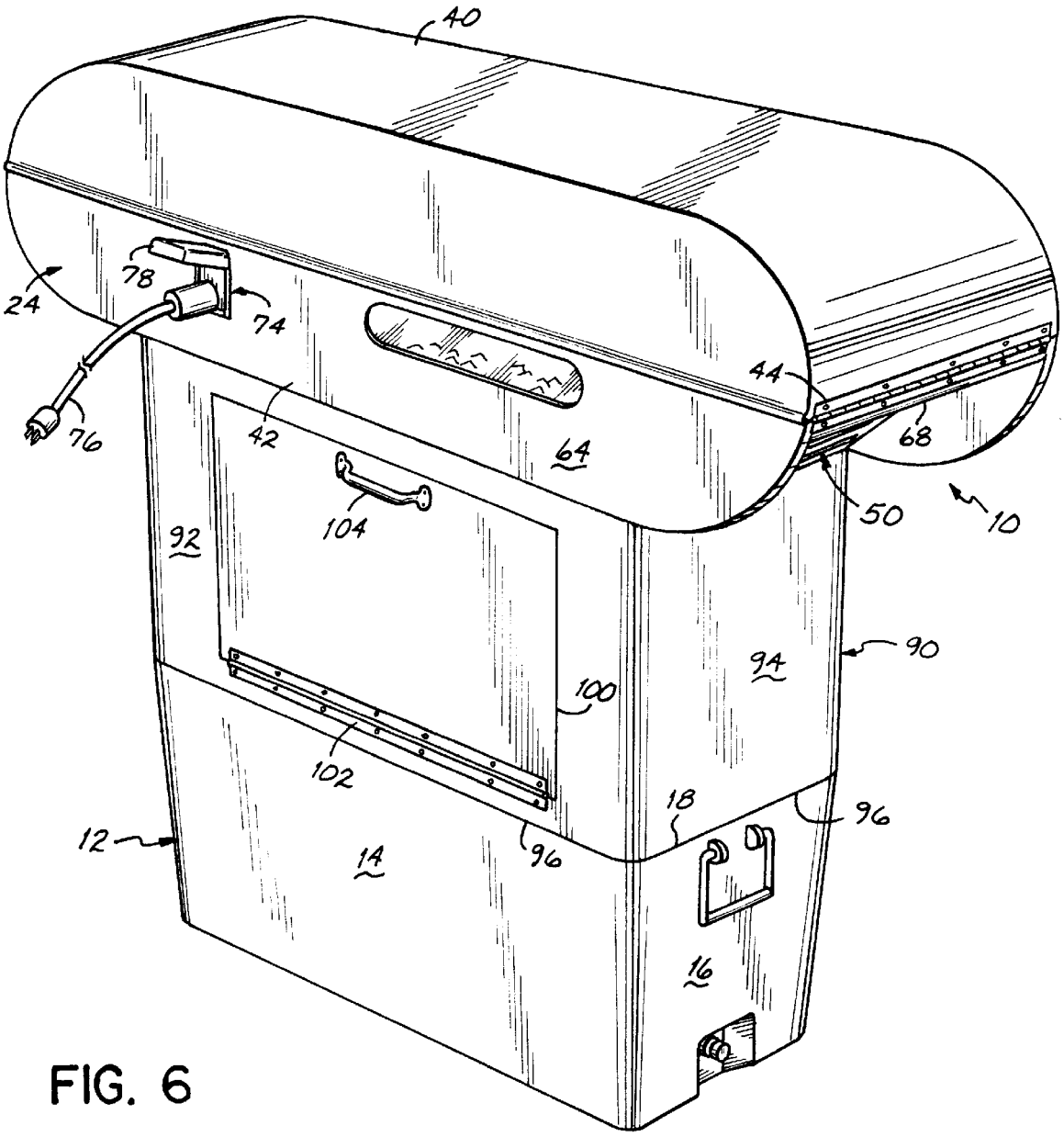
FIG. 6 is a perspective view similar to FIG. 1, showing the addition of an extension member between the cooler and the ice-making apparatus.

A 162-quart capacity cooler can hold about 130 pounds of ice made by the ice-making apparatus 10. Since the apparatus 10 is capable of making up to 200 pounds or more of ice per day, a standard 162-quart cooler is inadequate to hold a full day's production of ice from the apparatus 10. Therefore, once the cooler 12 is full, the portable ice-making apparatus 10 may be shut down and reset on another insulated cooler to restart production. Alternatively, in order to increase the holding capacity at a single location, the apparatus 10 may be provided with a cooler extension 90, as shown in FIG. 6. The cooler extension 90 has four vertical walls including two side walls 92 and two end walls 94, which are joined together at their end edges to define a rectangular box open at the top and bottom. The side walls 92 and end walls 94 have lower edges 96 and 98, respectively, which are adapted to rest securely atop the upper edge 18 of the cooler 12. The upper edges (not shown) of the walls 92 and 94 are configured similar to the upper edge 18 of the cooler 12. Thus, the apparatus 10 rests atop the cooler extension 90. The cooler extension 90 includes a door 100 in one of the side walls 92. The door 100 is pivotally connected to the side wall 92 via a hinge 102 at the lower edge of the door 100, and the door includes a handle 104 which may be grasped to open the door 100 so as to access ice from the cooler 12 and cooler extension 90.

Accordingly, it will be appreciated that the invention solves a long-felt need for providing ice in large quantities in outdoor remote applications. This eliminates the need for a dedicated ice-machine shelter as well as the need to supplement ice supplies by purchasing ice from an off-site source. Additionally, the invention provides a portable, large-capacity ice maker useful to fill a variety of typically available insulated coolers. The invention, through its portability and large-production capacity, significantly enhances the profitability of supplying ice particularly in remote and outdoor locations.

While the present invention has been illustrated by a description of a preferred embodiment and while this embodiment has been described in considerable detail, the invention in its broader aspects is not limited to the specific details, representative apparatus and method, and illustrative example shown and described. Additional advantages and modifications will readily appear to those skilled in the art without departing from the scope of the invention.

What is claimed is:

1. A portable ice-making apparatus for removable use on top of an insulated cooler, the apparatus comprising:

a portable housing having a bottom;

means for making ice disposed in said housing; and means on said housing bottom for removable mounting said housing and said ice-making means on an open top end of an insulated cooler for receiving ice made in and discharged from said ice-making means;

said housing being portable and selectively mountable through said mounting means on a selected one of a plurality of insulated coolers wherein the mounting means comprises a frame including a generally horizontal bottom wall having a perimeter which includes first and second opposite side edges of the bottom wall, the bottom wall having lower mating surfaces inward of the perimeter and an opening inward of the mating surfaces, the mating surfaces being adapted to rest on an upper peripheral edge of a cooler;

the ice-making means being supported by the frame and positioned to dispense ice through the opening into the cooler;

the housing containing the frame and ice-making unit and including first and second depending lips parallel to and outward of the first and second side edges of the bottom wall, respectively, the lips extending below the vertical level of the mating surfaces to prevent the apparatus from sliding transversely off the cooler.

2. The apparatus of claim 1 wherein the lips have sufficient structural strength to support the apparatus on a generally planar surface with the lips resting thereon.

3. A portable ice-making apparatus for removable use on top of an insulated cooler, the apparatus comprising:

a portable housing having a bottom;

means for making ice disposed in said housing; and means on said housing bottom for removably mounting said housing and said ice-making means on an open top end of an insulated cooler for receiving ice made in and discharged from said ice-making means;

said housing being portable and selectively mountable through said mounting means on a selected one of a plurality of insulated coolers wherein the housing includes an upper wall which extends outward to an outermost edge, a lower wall which lies vertically below the upper wall, and a vent in the lower wall, the vent being spaced inward of the outermost edge, the vent being protected from downwardly falling precipitation by the upper wall.

4. A portable ice-making apparatus for removable use on top of an insulated cooler, the apparatus comprising:

a portable housing having a bottom;

means for making ice disposed in said housing; and means on said housing bottom for removably mounting said housing and said ice-making means on an open top end of an insulated cooler for receiving ice made in and discharged from said ice-making means;

said housing being portable and selectively mountable through said mounting means on a selected one of a plurality of insulated coolers wherein the housing includes opposite end walls, each end wall having an upper portion which extends downwardly and outwardly to an outer edge and a lower portion having a vent therein located below the upper portion and inward of the outer edge, the vents being protected from downwardly falling precipitation by the upper portions of the end walls.

5. The apparatus of claim 4 wherein the lower portion of each end wall is angled downwardly and inwardly from the respective outer edge.

6. A portable ice-making apparatus for removable use on top of an insulated cooler, the apparatus comprising:

a portable housing having a bottom:

means for making ice disposed in said housing; and means on said housing bottom for removable mounting said housing and said ice-making means on an open top end of an insulated cooler for receiving ice made in and discharged from said ice-making means;

said housing being portable and selectively mountable through said mounting means on a selected one of a plurality of insulated coolers wherein the housing has a lower body portion and an upper lid portion removably attached to the body portion, the body portion including upstanding walls having upper edges, the lid portion including depending walls having lower edges, the lower edges of the lid portion engaging the upper edges of the body portion to form a joint therebetween which substantially prevents infiltration of water through the joint into the housing interior; and wherein the upstanding walls of the body portion include two opposite side walls and two opposite end walls, each end wall sloping upwardly and outwardly and having a vent therein, the depending walls of the lid portion including two opposite side walls and two opposite end walls, the side walls of the lid portion engaging the side walls of the body portion at the joint and the end walls of the lid portion engaging the end walls of the body portion at the joint, the end walls of the lid portion overhanging the vents, whereby the end walls of the lid portion shield the vents from infiltration of precipitation.

7. A portable ice-making apparatus comprising:

an ice-making unit; and a housing containing the ice-making unit, the housing including a top wall, two opposite side walls, and two opposite end walls, each end wall being generally convex shaped with an upper portion extending generally outwardly and downwardly to an outermost edge and a lower portion extending generally downwardly and inwardly from the outermost edge, at least one of the end walls including a vent in the lower portion thereof, the vent being spaced inward of the outermost edge beneath the upper portion of the end wall so as to be shielded from downwardly falling precipitation by the upper portion of the end wall.

8. The apparatus of claim 7, wherein there is a vent in each of the lower portions of each end wall, each vent being spaced inward of the respective outermost edge beneath the respective upper portion of the end wall such that the vents are shielded from downwardly falling precipitation by the upper portions of the end walls.

9. A combination of a portable ice-making apparatus with a storage bin, comprising:

a storage bin including a bottom wall and four upstanding side walls, the side walls having upper edges; and a portable ice-making apparatus removably resting atop the storage bin, the apparatus including:

a frame including a generally horizontal bottom wall having a perimeter which includes first and second opposite side edges of the bottom wall, the bottom wall having lower mating surfaces inward of the perimeter and an opening inward of the mating surfaces, the mating surfaces resting on an upper peripheral edge of the storage bin;

an ice-making unit supported by the frame and positioned to dispense ice through the opening into the storage bin; and a housing containing the frame and ice-making unit and including first and second depending lips parallel to and outward of the first and second side edges of the bottom wall, respectively, the lips extending below the vertical level of the mating surfaces to prevent the apparatus from sliding transversely off the storage bin.

10. The combination of claim 9 wherein the housing includes an upper wall which extends outward to an outermost edge, a lower wall which lies vertically below the upper wall, and a vent in the lower wall, the vent being spaced inward of the outermost edge, the vent being protected from downwardly falling precipitation by the upper wall.

11. The combination of claim 9 wherein the housing includes opposite end walls, each end wall having an upper portion which extends downwardly and outwardly to an outer edge and a lower portion having a vent therein located below the upper portion and inward of the outer edge, the vents being protected from downwardly falling precipitation by the upper portions of the end walls.

12. The combination of claim 11 wherein the lower portion of each end wall is angled downwardly and inwardly from the respective outer edge.

13. The combination of claim 9 wherein the housing has a lower body portion and an upper lid portion removably attached to the body portion, the body portion including upstanding walls having upper edges, the lid portion including depending walls having lower edges, the lower edges of the lid portion engaging the upper edges of the body portion to form a joint therebetween which substantially prevents infiltration of water through the joint into the housing interior.

14. The combination of claim 13 wherein the lower edges of the lid portion overlap the upper edges of the body portion.

15. The combination of claim 13 wherein the upstanding walls of the body portion include two opposite side walls and two opposite end walls, each end wall sloping upwardly and outwardly and having a vent therein, the depending walls of the lid portion including two opposite side walls and two opposite end walls, the side walls of the lid portion engaging the side walls of the body portion at the joint and the end walls of the lid portion engaging the end walls of the body portion at the joint, the end walls of the lid portion overhanging the vents, whereby the end walls of the lid portion shield the vents from infiltration of precipitation.

16. The combination of claim 9, wherein the storage bin includes a lower portion having the bottom wall, and an upper portion removably attached to the lower portion, the lower and upper portions together defining the side and end walls of the storage bin, the ice-making apparatus removably resting atop the upper portion of the storage bin.

17. The combination of claim 16 wherein the upper portion of the storage bin includes a door providing access to the interior of the storage bin.

* * * * *